US010751635B2

(12) United States Patent
Payne et al.

(10) Patent No.: US 10,751,635 B2
(45) Date of Patent: Aug. 25, 2020

(54) REMOTE-CONTROLLED TOY VEHICLE RACING SYSTEM

(71) Applicant: Mattel, Inc., El Segundo, CA (US)

(72) Inventors: Julian Richard Payne, Los Angeles, CA (US); Jason K. (Kuan Chieh) Chen, Arcadia, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 16/113,233

(22) Filed: Aug. 27, 2018

(65) Prior Publication Data

US 2020/0061481 A1 Feb. 27, 2020

(51) Int. Cl.

| | |
|---|---|
| ***A63H 30/04*** | (2006.01) |
| ***A63H 18/12*** | (2006.01) |
| ***A63H 18/02*** | (2006.01) |
| ***A63H 18/16*** | (2006.01) |
| *A63H 17/26* | (2006.01) |
| *A63H 17/38* | (2006.01) |

(52) U.S. Cl.

CPC ..... *A63H 30/04* (2013.01); *A63H 18/023* (2013.01); *A63H 18/026* (2013.01); *A63H 18/028* (2013.01); *A63H 18/12* (2013.01); *A63H 18/16* (2013.01); *A63H 17/262* (2013.01); *A63H 17/264* (2013.01); *A63H 17/38* (2013.01)

(58) Field of Classification Search

CPC ..... A63H 17/00; A63H 17/14; A63H 17/26; A63H 18/02; A63H 18/08; A63H 18/16; A63H 29/22; A63H 30/04; A63H 18/12; A63G 7/00; A63G 21/06

USPC ..... 446/433, 444, 454–456, 465, 470, 484; 472/85–87; 104/53, 83

See application file for complete search history.

(56) References Cited

U.S. PATENT DOCUMENTS

| | | | | |
|---|---|---|---|---|
| 3,209,491 | A | 10/1965 | Roeper | |
| 3,712,615 | A | 1/1973 | Staats et al. | |
| 3,751,847 | A | 8/1973 | Neuhierl | |
| 3,775,897 | A | 12/1973 | Soulakis | |
| 3,858,875 | A | 1/1975 | Nemeth | |
| 3,860,237 | A | 1/1975 | Cooper et al. | |
| 3,958,361 | A | 5/1976 | Cooper et al. | |
| 3,970,309 | A | 7/1976 | Sato | |
| 4,094,089 | A | 6/1978 | Sano | |
| 4,147,351 | A | 4/1979 | Saito | |
| 4,382,599 | A | 5/1983 | Tilbor | |
| 4,383,688 | A | 5/1983 | Prehodka | |
| 4,536,168 | A | 8/1985 | Stephens | |
| 4,550,910 | A | 11/1985 | Goldfarb et al. | |
| 4,715,843 | A | 12/1987 | Ostendorff et al. | |
| 4,920,890 | A * | 5/1990 | Barber | A63G 25/00 104/292 |
| 5,085,148 | A | 2/1992 | Konno | |

(Continued)

*Primary Examiner* — Kien T Nguyen

(74) *Attorney, Agent, or Firm* — Edell, Shapiro & Finnan, LLC

(57) ABSTRACT

A toy vehicle racing system is disclosed. The toy vehicle racing system comprises a track set including a movable mechanism and a toy vehicle configured to travel along the track set and interact with the movable mechanism. The toy vehicle racing system also includes a remote control in wireless communication with the track set. The remote control is configured to transmit instructions to the track set to move the movable mechanism and also to receive information from the track set regarding the track set and/or toy vehicle.

20 Claims, 8 Drawing Sheets

(56) References Cited

U.S. PATENT DOCUMENTS

| | | | | |
|---|---|---|---|---|
| 5,299,969 | A | 4/1994 | Zaruba | |
| 5,542,668 | A | 8/1996 | Casale et al. | |
| 5,767,655 | A | 6/1998 | Ostendorff et al. | |
| 6,762,586 | B2 | 7/2004 | Choi | |
| 7,367,533 | B2 | 5/2008 | Yamaguchi et al. | |
| 7,618,302 | B2 | 11/2009 | Collins et al. | |
| 7,794,301 | B2 | 9/2010 | Ostendorff et al. | |
| 7,845,876 | B2 * | 12/2010 | Burry | A63K 3/02 404/6 |
| 8,176,852 | B2 | 5/2012 | O'connor | |
| 8,545,284 | B2 * | 10/2013 | Baarman | A63H 17/26 446/444 |
| 8,567,690 | B2 | 10/2013 | De La Torre | |
| 8,814,628 | B2 | 8/2014 | O'connor et al. | |
| 9,421,473 | B2 | 8/2016 | Ostendorff et al. | |
| 9,452,366 | B2 | 9/2016 | Schmid et al. | |
| 2002/0046675 | A1 | 4/2002 | Young | |
| 2004/0090206 | A1 * | 5/2004 | Choi | A63H 18/12 320/107 |
| 2018/0041053 | A1 * | 2/2018 | Capizzo | H02J 7/0027 |

* cited by examiner

REMOTE-CONTROLLED TOY VEHICLE RACING SYSTEM

FIELD OF THE INVENTION

The present invention relates generally to track sets for toy vehicles, and in particular, remote-controllable track sets.

BACKGROUND OF THE INVENTION

Children of all ages enjoy watching and racing toy vehicles on track sets. Typically, such toy vehicles have electric motors or external launchers that propel them continuously along the track set. To provide greater play value and enjoyment, the track sets often have different raceway configurations and include various stunt features such as curves, loops, and ramps. Other ways of interacting with the toy vehicles being raced, such as controlling the toy vehicles remotely, provide additional fun and excitement to the child.

However, controlling toy vehicles along a track set at high speeds may be too demanding and difficult for inexperienced users or younger children. Thus, there is a need for a simple yet engaging system for interactively racing toy vehicles. There is also a desire for a toy vehicle racing system that provides augmented reality (AR) features related to the track set and/or toy vehicles for enhanced entertainment and enriched sensory experiences while racing the toy vehicles.

SUMMARY OF THE INVENTION

The present invention provides a toy vehicle racing system that allows one or more users to interact with the track set for a more engaging racing experience. The toy vehicle racing system includes a track set with movable mechanisms and toy vehicles configured to travel along the track set and interact with the movable mechanisms. Using remote controls configured to wirelessly communicate with the track set, users control the movable mechanisms to guide or alter the movement of the toy vehicles racing on the track set. The users are further able to receive real-time information and status updates of the track set and toy vehicles through the remote controls.

According to one aspect of the present invention, the toy vehicle racing system comprises a track set including a movable mechanism and a toy vehicle configured to travel along the track set and interact with the movable mechanism. The toy vehicle racing system also includes a remote control in wireless communication with the track set. The remote control is configured to transmit instructions to the track set to move the movable mechanism and also to receive information from the track set regarding the track set and/or toy vehicle.

In one or more embodiments, the information received from the track set includes at least one of an activation status of the movable mechanism, stored battery charge of the toy vehicle, and triggering of a sensor on the track set. In other embodiments, the instructions transmitted to the track set include at least one of moving the movable mechanism and delivering power to the toy vehicle at a selected charging speed and/or to a selected percentage of the toy vehicle's battery capacity.

In one instance, the movable mechanism is a diverter that diverts the toy vehicle traveling on the track set while the diverter is activated. In another instance, the movable mechanism is a pit stop gate that traps the toy vehicle while the pit stop gate is activated. In some embodiments, the track set includes an electrical contact that contacts the toy vehicle while the toy vehicle is trapped by the pit stop gate. A charging controller selectively delivers power to the toy vehicle through the electrical contact while the toy vehicle is trapped by the pit stop gate. The charging controller regulates a charging speed and/or an amount of power delivered to the toy vehicle.

In further embodiments, the remote control receives information when a track set sensor on the track set is triggered. The track set sensor is triggered when the toy vehicle is diverted by a diverter, trapped by a pit stop gate, released by the pit stop gate, or passes the track set sensor while traveling on the track set.

According to another aspect of the present invention, the toy vehicle racing system comprises a track set including a first movable mechanism and a second movable mechanism. A first toy vehicle and a second toy vehicle are configured to travel along the track set and respectively interact with the first and second movable mechanisms. The toy vehicle racing system also includes a first remote control and a second remote control. The first remote control is in wireless communication with the track set. The first remote control is configured to transmit instructions to the track set to move the first and/or second movable mechanism and further configured to receive information from the track set regarding the track set, the first toy vehicle, and/or the second toy vehicle. The second remote control in wireless communication with the first remote control. The second remote control is configured to transmit instructions to the first remote control to move the first and/or second movable mechanism and further configured to receive information from the first remote control regarding the track set, the first toy vehicle, and/or the second toy vehicle. The first remote control relays the instructions transmitted by the second remote control to the track set and further relays the information received from the track set to the second remote control.

In one or more embodiments, the information received from the track set by the first or second remote control includes at least one of an activation status of the first or second movable mechanism, stored battery charge of the first or second toy vehicle, and triggering of a first or second sensor on the track set. In other embodiments, the instructions transmitted to the track set by the first or second remote control include at least one of moving the first or second movable mechanism and delivering power to the first or second toy vehicle at a selected charging speed and/or to a selected percentage of a battery capacity.

In one instance, the first and second movable mechanisms are diverters that respectively divert the first or second toy vehicles traveling on the track set while the diverter is activated. In another instance, the first and second movable mechanisms are pit stop gates that respectively trap the first or second toy vehicle while the pit stop gate is activated. In some embodiments, the track set comprises electrical contacts that respectively contact the first or second toy vehicle while the respective toy vehicle is trapped by the pit stop gate. A charging controller selectively delivers power to the first or second toy vehicle through the electrical contacts while the respective toy vehicle is trapped by the pit stop gate. The charging controller regulates a charging speed and/or an amount of power delivered to the first or second toy vehicle.

In further embodiments, the first and second remote controls receive information when a first track set sensor or a second track set sensor on the track set is triggered. The first or second track set sensor is triggered when the first or second toy vehicle is diverted by a diverter, trapped by a pit stop gate, released by the pit stop gate, or passes the first or second track set sensor while traveling on the track set. In yet other embodiments, the first remote control communicates with the track set using a first communication protocol. The second remote control communicates with the first remote control using a second communication protocol and the second communication protocol is different from the first communication protocol.

According to yet another aspect of the present invention, the toy vehicle racing system comprises a track set including a first movable mechanism and a second movable mechanism. A first toy vehicle and a second toy vehicle are configured to travel along the track set and respectively interact with the first and second movable mechanisms.

The toy vehicle racing system also includes a first remote control and a second remote control. The first remote control is in wireless communication with the track set and includes a first camera, a first processor, and a first display screen. The first camera is configured to capture a first real-time video feed. The first processor is configured to generate a first composite view comprising a first computer-generated image superimposed on the first real-time video feed. The first display screen is configured to display the first composite view. Furthermore, the first remote control is configured to transmit instructions to the track set to move the first and/or second movable mechanism. The first remote control also receives information from the track set regarding the track set, the first toy vehicle, and/or the second toy vehicle, as well as updates the first computer-generated image based on the received information.

The second remote control is in wireless communication with the first remote control and includes a second camera, a second processor, and a second display screen. The second camera is configured to capture a second real-time video feed. The second processor is configured to generate a second composite view comprising a second computer-generated image superimposed on the second real-time video feed. The second display screen is configured to display the second composite view. Furthermore, the second remote control is configured to transmit instructions to the first remote control to move the first and/or second movable mechanism. The second display screen receives information from the first remote control regarding the track set, the first toy vehicle, and/or the second toy vehicle, as well as updates the second computer-generated image based on the received information. The first remote control relays the instructions transmitted by the second remote control to the track set and further relays the information received from the track set to the second remote control.

In one or more embodiments, the first processor is configured to recognize the first toy vehicle, second toy vehicle, and/or track set in the first real-time video feed from the first camera and superimpose the first computer-generated image on a portion of the first toy vehicle, second toy vehicle, and/or track set in the first real-time video feed. Similarly, the second processor is configured to recognize the first toy vehicle, second toy vehicle, and/or track set in the second real-time video feed from the second camera and superimpose the second computer-generated image on a portion of the first toy vehicle, second toy vehicle, and/or track set in the second real-time video feed.

In other embodiments, the first and second display screens are touchscreens and the first and second computer-generated images respectively represent first and second interactive elements. Contacting the first or second interactive elements on the respective first or second display screens causes the respective first or second remote control to transmit instructions to the track set.

Other objects, features and advantages of the present invention will become apparent to those skilled in the art from the following detailed description. It is to be understood, however, that the detailed description and specific examples, while indicating some embodiments of the invention, are given by way of illustration and not limitation. Many changes and modifications within the scope of the invention may be made without departing from the spirit thereof, and the present invention includes all such modifications.

BRIEF DESCRIPTION OF THE DRAWINGS

Referring now to the drawings in which like reference numbers represent corresponding parts throughout:

FIG. 2A illustrates a perspective view of the track set and toy vehicles. FIG. 2B illustrates a plan view of a toy vehicle traveling through the pit stop section of the track set;

FIG. 3A illustrates a top perspective view of the toy vehicle and FIG. 3B illustrates a bottom perspective view of the toy vehicle;

DETAILED DESCRIPTION OF THE INVENTION

A toy vehicle racing system according to the present invention allows one or more users to interactively race toy vehicles along a track set. The users remotely control movable mechanisms on a track set, which guides and/or alters the movement of toy vehicles racing on the track set. In certain embodiments, the racing system further includes augmented reality (AR) features and elements, such as computer-generated graphics, sounds, and haptic feedback, that are implemented through the remote controls used to control the moveable mechanisms on the track set. These AR features and elements offer a more visually enticing racing environment and enhance the overall racing experience.

Figure 1:
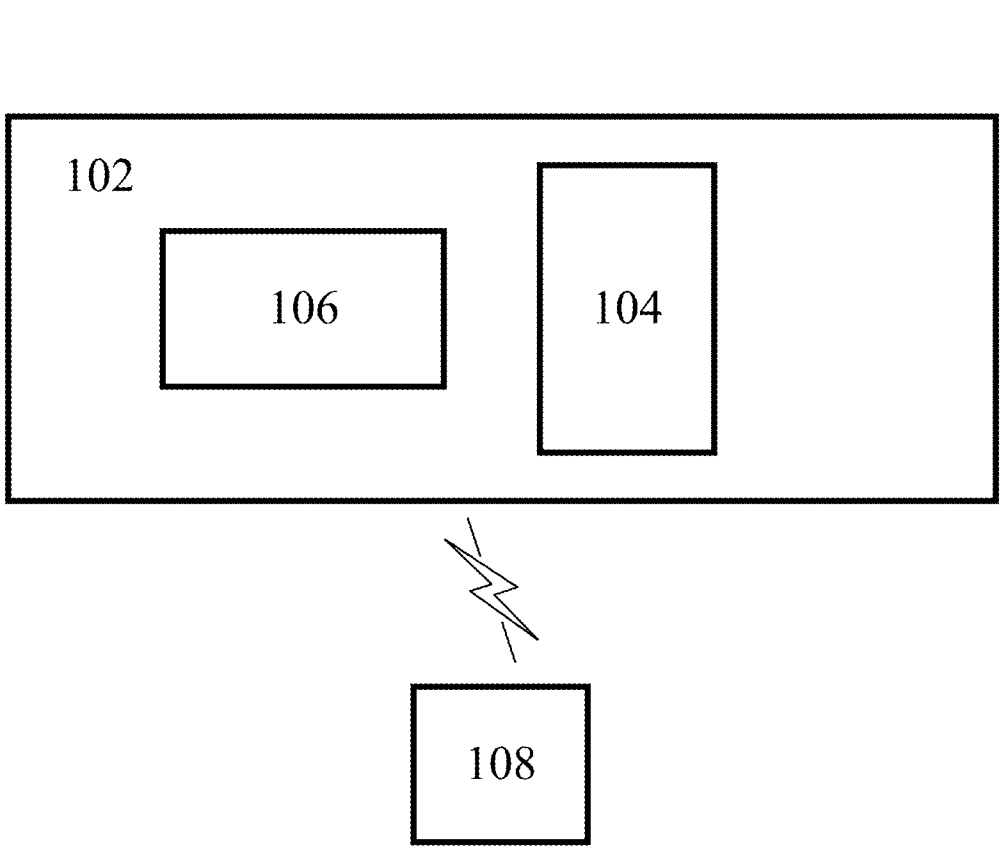
FIG. 1 illustrates a general block diagram of a toy vehicle racing system, according to an embodiment of the invention.

According to a general embodiment of the present invention, a simplified block diagram of a toy vehicle racing system 100 is shown in FIG. 1. The toy vehicle racing system 100 includes a track set 102 with a movable mechanism 104. A toy vehicle 106 is configured to travel along the track set 102 and interact with the movable mechanism 104. A remote control 108 is further configured to wirelessly communicate with the track set 102 and control the movable mechanism 104 to guide or alter the movement of the toy vehicle 106 traveling on the track set 102. The remote control also receives information from the track set 102 regarding the track set 102, movable mechanism 104, and/or toy vehicle 106.

Figure 2A:
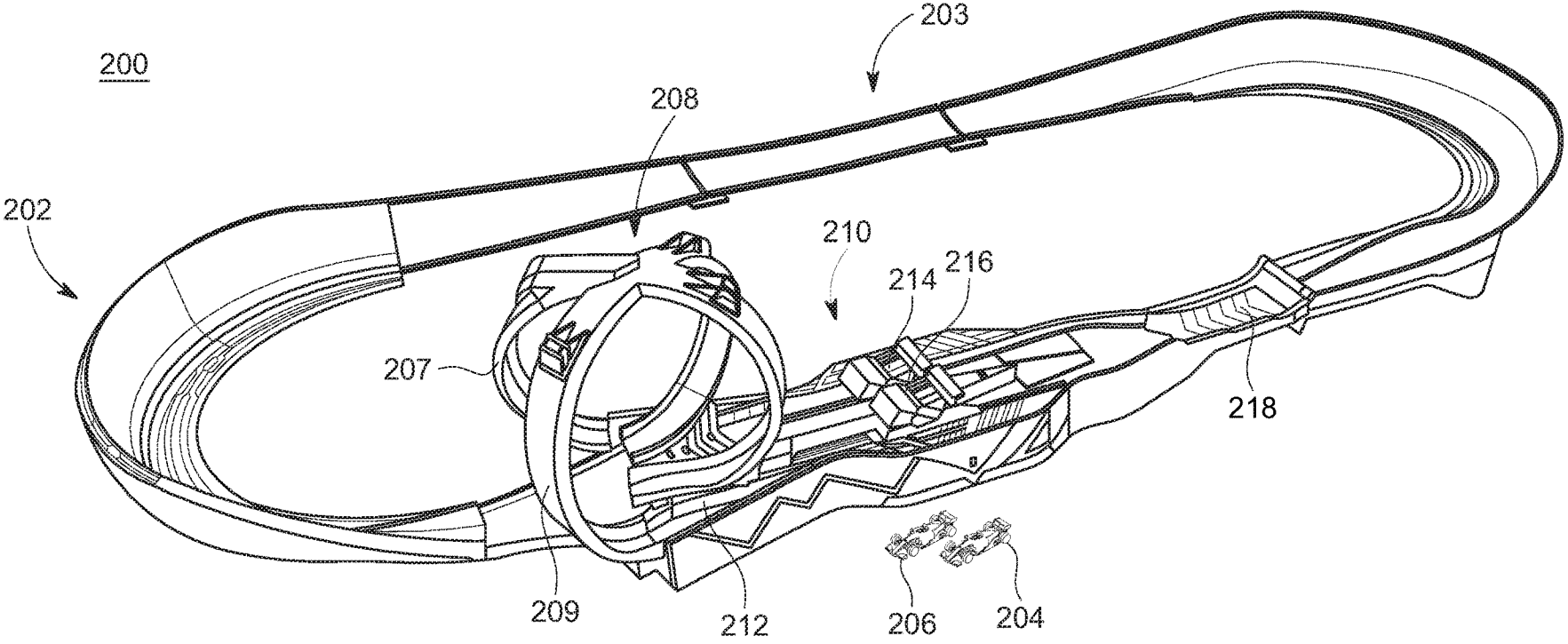
FIGS. 2A-B illustrate various views of a track set and toy vehicles, in accordance with one embodiment of the invention.

Referring now to FIG. 2A, an illustrative embodiment of a track set 202 for a toy vehicle racing system 200 is shown. Here, the track set 202 is a generally oval raceway in which two toy vehicles 204, 206 compete by racing in a clockwise direction. The track set 202 may be configured with any raceway layout suitable for racing toy vehicles, for example a figure-8 layout or a more complex layout involving additional curves, ramps, and loops, etc. The toy vehicle racing system 200 may further be designed to race any number of toy vehicles, for example a single toy vehicle or more than two toy vehicles.

In a preferred embodiment, the track set 202 is constructed from individual track sections, including straight and curved track sections of a main racing segment 203, a dual loop section 208, and a pit stop section 210. When separated into its individual parts and track sections, the track set 202 can be packaged and stored in a more compact space. In an exemplary implementation, the individual track sections are coupled together using track connectors to form a continuous raceway. The track connector may be any structure suitable for facilitating selective end-to-end connection or coupling of a track section to another track section. For instance, the track connector may be configured as tongue-and-groove friction-fit connectors or snap-together nesting tabs. In some embodiments, the track sections of the track set are reconfigurable to create one or more different track layouts. Furthermore, additional track sections may be added or removed to create a different and/or more complex raceway. Unless otherwise specified, the track set may, but is not required to, contain at least one of the track sections, structures, components, mechanisms, and/or features described, illustrated, and/or incorporated herein.

A substantial portion of the track set 202 comprises a main racing segment 203 that the toy vehicles 204, 206 travel along while racing on the track set 202. Here, they jockey for position and may come into contact with/crash into each other while racing. In some embodiments, instead of a single lane, the main racing segment 203 has a plurality of segregated racing lanes that prevent the toy vehicles 204, 206 from crashing into each other. The main racing segment 203 also has raised edges or guide rails that help keep the toy vehicles 204, 206 within the main racing segment 203. Depending on the speed of the toy vehicles 204, 206, various portions of the main racing segment 203 may be further tilted or banked to help prevent the toy vehicles 204, 206 from going off the track set 202.

Figure 2B:
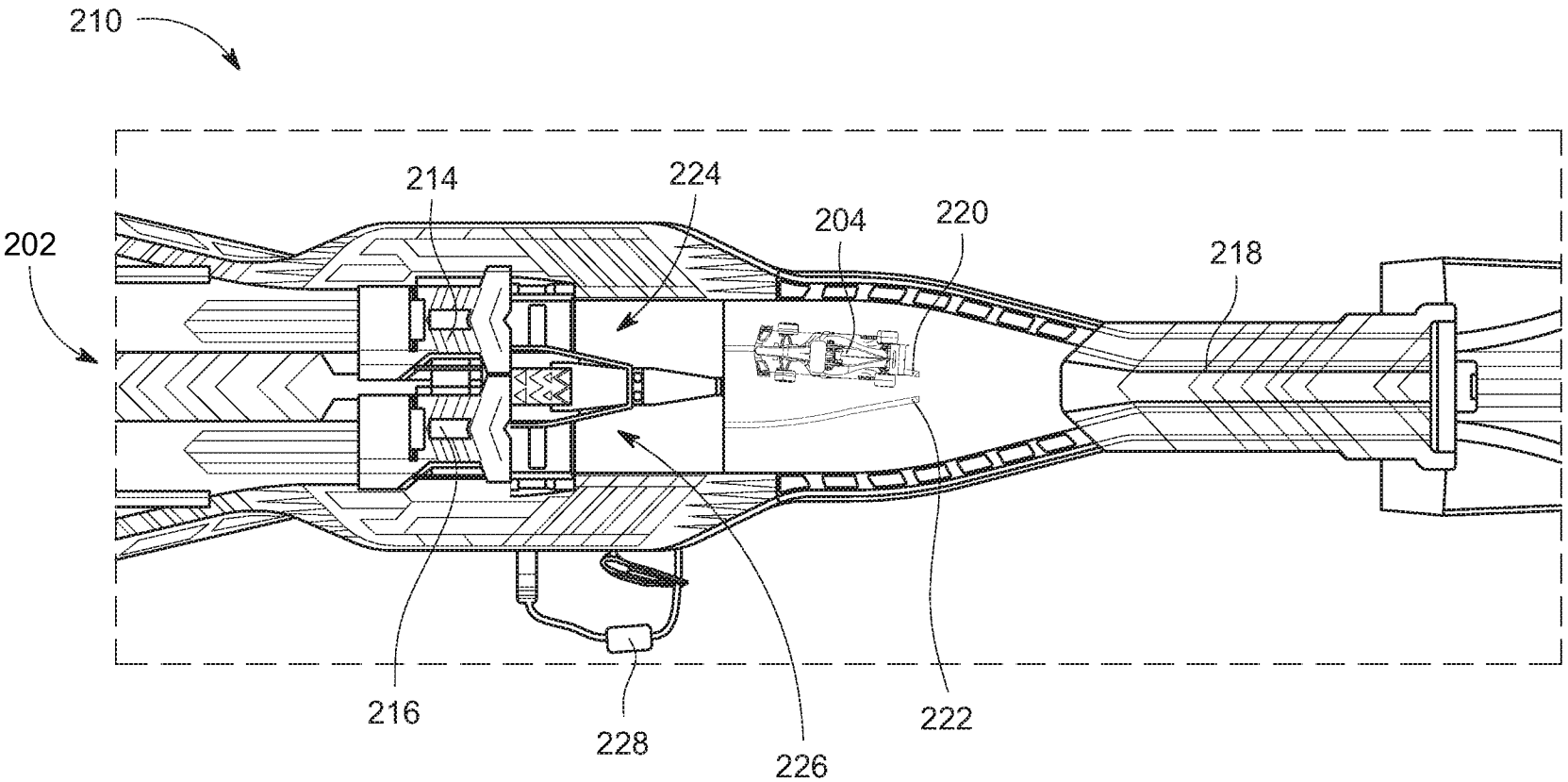

The track set 202 also includes a pit stop section 210, as shown more closely in FIG. 2B. The pit stop section 210 comprises pit stop gates 214, 216 that are positionable in open and closed positions by pivoting upwards and downwards, respectively. While the pit stop gate is in the open position, the toy vehicle is able to freely pass through the pit stop section 210. When the pit stop gate is in the closed position, the pit stop gate physically prevents the toy vehicle from passing through the pit stop section 210. An incoming toy vehicle is trapped and retained in the pit stop section 210 until the pit stop gate is moved back to the open position.

As also shown in FIG. 2B, the pit stop section 210 includes vehicle splitters 220, 222 protruding from the surface of the track. The vehicle splitters 220, 222 segregate the first toy vehicle 204 and second toy vehicle 206 to a respective right lane 224 and left lane 226. Thus, as the toy vehicles 204, 206 pass through the pit stop section 210, the first toy vehicle 204 always travels in the right lane 224 (as shown in FIG. 2B) and the second toy vehicle 206 always travels in the left lane 226 (not shown). This prevents a toy vehicle from crashing into the other toy vehicle while it is retained by a pit stop gate. For example, if the second toy vehicle 206 is retained in the left pit stop gate 216, the first toy vehicle 204 is still able to pass through the pit stop section 210 without crashing into the second toy vehicle 206 since the splitter 220 forces the first toy vehicle 204 to always travel in the right lane 224. A top cover 218 is further attached to a portion of the raceway before the pit stop section 210. The top cover 218 prevents the toy vehicles 204, 206 from flying uncontrollably off the raceway as they enter the pit stop section 210 of the track set 202.

Figure 3A:
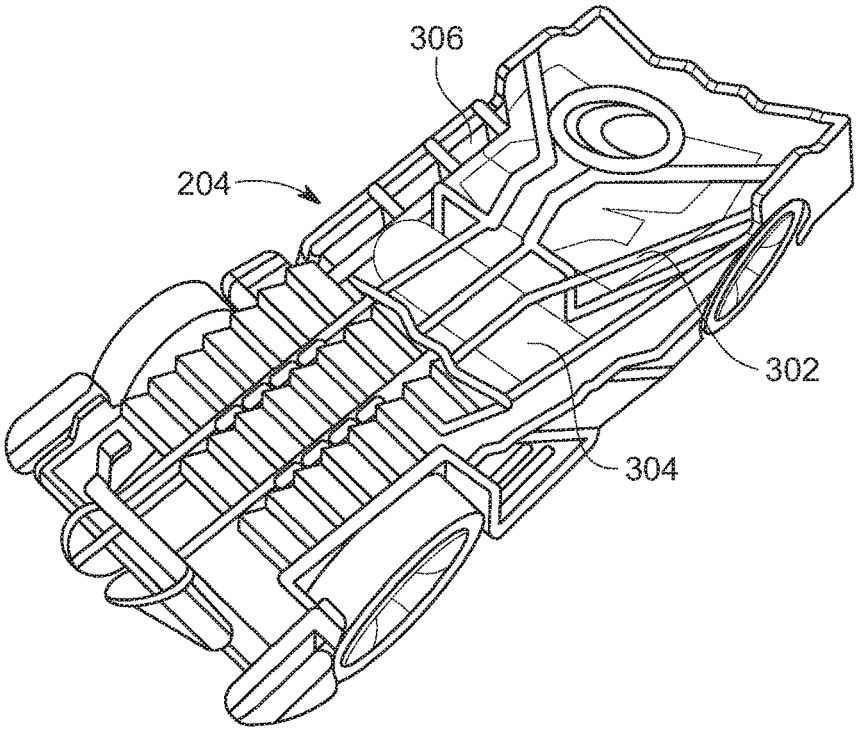
FIGS. 3A-B illustrate various views of a toy vehicle, in accordance with an embodiment of the invention.
Figure 3B:
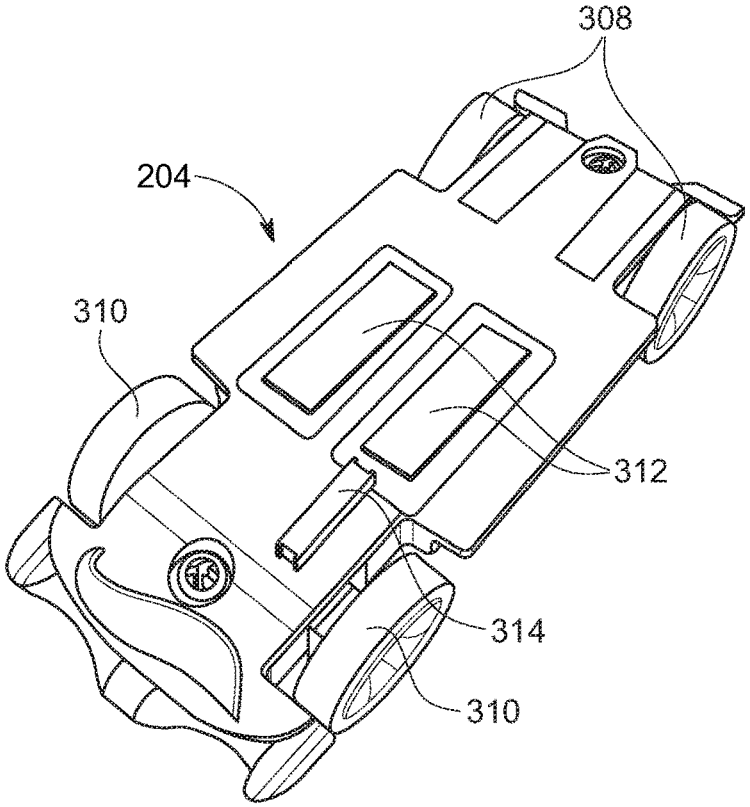

FIGS. 3A and 3B show an embodiment of the toy vehicle 204 that is configured to travel along the track set 202. Toy vehicle 204 has a housing cover 306, typically made of plastic, that improves the aerodynamics of the toy vehicle 204 and provides protection for the components housed within (see FIG. 3A). Furthermore, the housing cover 306 may have different designs and/or decorations, which contribute to the aesthetics of the toy vehicle 204 as well as allow a user more easily differentiate the toy vehicle 204 from other toy vehicles that are also racing on the track set at the same time.

In some embodiments, the toy vehicle 204 includes a radio-frequency identification (RFID) tag that can be detected by a reader in the track set. This allows information and data such as the number of laps/races completed, win/loss record, performance/gameplay statistics, on-screen appearance etc. to be collected, stored, and/or configured for individual toy vehicles. Thus, each toy vehicle has a personalized identity, which makes racing different toy vehicles against each other more interesting and fun.

Underneath the housing cover 306 is an electric motor 302 and a rechargeable battery 304 that provides power to the electric motor 302. In one instance, the rear wheels 308 of the toy vehicle 204 are driven by the electric motor 302. In other instances, the front wheels 310 or all four wheels are driven by the electric motor 302. Typically, the wheels 308, 310 cannot be steered and only allow the toy vehicle 204 to travel in a forward direction while being guided by the track set 202. In other embodiments, a user can steer the toy vehicle 204 on the track set 202 in addition to controlling various mechanisms and features of the track set 202.

The underside of the toy vehicle 204 includes a guide 314 (see FIG. 3B). The guide 314 is positioned to contact a vehicle splitter protruding from the surface of the track (see, e.g., vehicle splitters 220, 222 in FIG. 2B). Depending on the relative positions of the guide 314 and the contacted vehicle splitter, the toy vehicle 204 travels in a predetermined direction to a specific lane on the track. For instance in FIG. 3B, the guide 314 is positioned such that when the toy vehicle 204 travels across the pit stop section 210 shown in FIG. 2B, the guide 314 always contacts the vehicle splitter 220 which directs it to the right lane 224.

Also included on the underside of the toy vehicle 204 are electrical contacts 312 connected to the positive and negative terminals of the rechargeable battery 304. The electrical contacts 312 allow the toy vehicle 204 to be recharged while a user plays with it on the track set 202. The toy vehicle 204 is thus able to race on the track set 202 for an extended length of time. This also addresses the inconveniences associated with removing/changing batteries or plugging the toy vehicle into a separate charger in the middle of play. Since the speed of the toy vehicle 204 decreases in relation to its battery charge but recharging the toy vehicle 204 takes time, battery management becomes an important consideration and adds an extra layer of strategy when racing toy vehicles on the track set.

Figure 4:
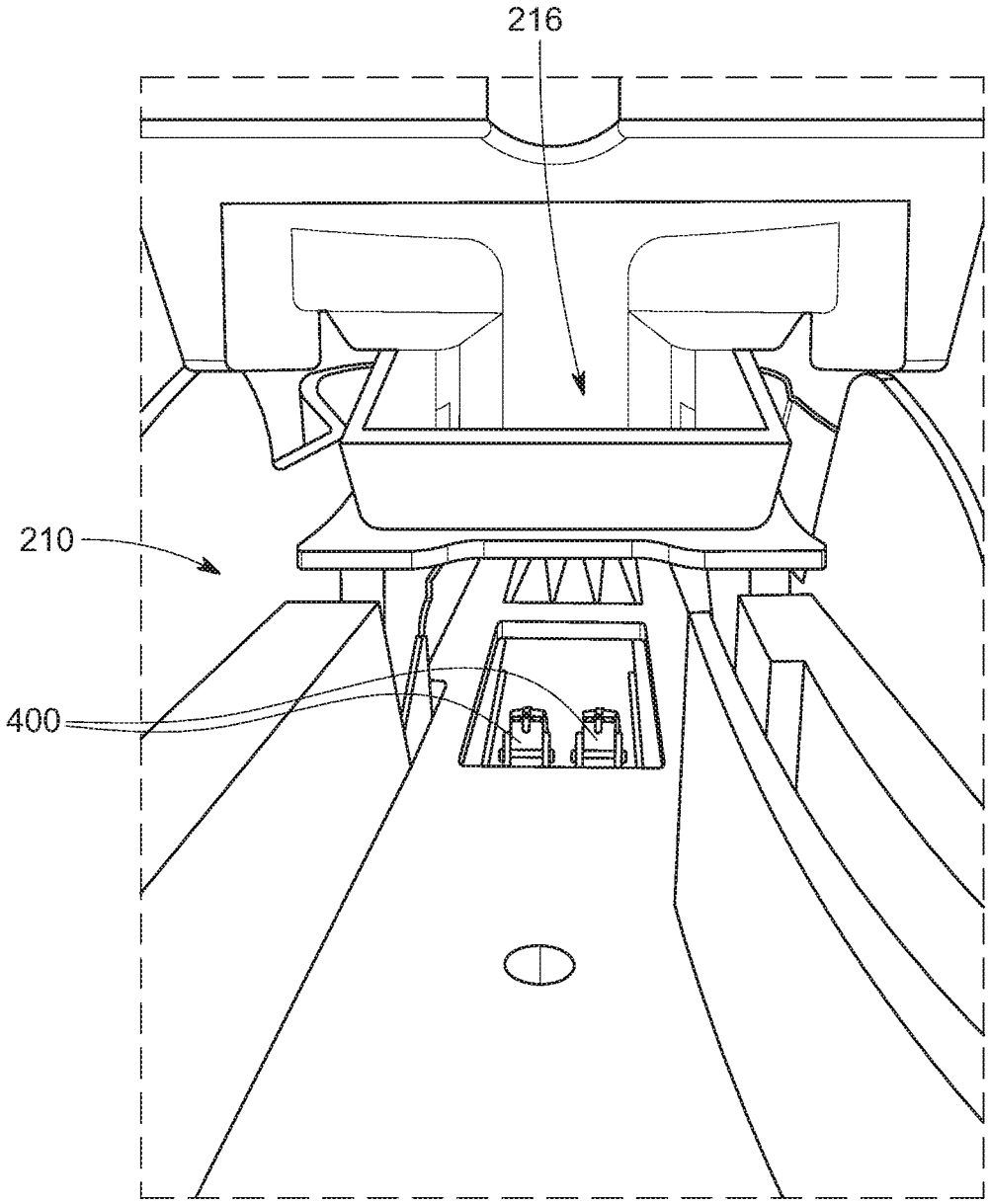
FIG. 4 illustrates a close-up view of a pit stop and the electrical contacts for charging a toy vehicle, in accordance with an embodiment of the invention.

In one or more embodiments, the toy vehicle is charged while it is retained by a pit stop gate. In the exemplary implementation shown in FIG. 4, the pit stop gate 216 includes electrical contacts 400 that are positioned to contact the electrical contacts on the underside of a toy vehicle. While the pit stop gate 216 is in an open position (as shown in FIG. 4), the electrical contacts 400 are recessed into the track surface and the toy vehicle can pass through the pit stop section 210 without any hindrance. When the pit stop gate 216 is activated to pivot downwards and trap an incoming toy vehicle, the electrical contacts 400 rise and protrude above the track surface. The electrical contacts 400 are then able to contact the electrical contacts on the underside of the toy vehicle (see, e.g., electrical contacts 312 in FIG. 3B) and allow the toy vehicle to be recharged by the track set 202 while it is retained by the pit stop gate 216. In one or embodiments, the electrical contacts 400 are mechanically coupled to the pit stop gate 216 such that closing the pit stop gate 216 (e.g., moving the pit stop gate 216 downwards) causes the electrical contacts 400 to protrude from the surface of the track (i.e., move upwards) and opening the pit stop gate 216 (e.g., moving the pit stop gate 216 upwards) causes the electrical contacts 400 to recede from the surface of the track (i.e., move downwards).

The track set 202 is preferably connected to an electrical outlet so that it has sufficient power to charge one or more toy vehicles multiple times. FIG. 2B shows a cable 228 attached to the track set 202 that supplies power from an electrical outlet. In other embodiments, the track set 202 uses batteries for power to recharge toy vehicles and actuate movable mechanisms. Referring back to FIG. 4, a charging controller (not shown) selectively controls the power delivered to the toy vehicle through the electrical contacts 400. The charging controller regulates various aspects of battery charging such as the charging speed and/or the amount of power delivered to the toy vehicle. This allows different gameplay elements and variables to be introduced to the racing dynamics of the toy vehicles. For example, increasing the power output allows a toy vehicle to be charged faster and reduces the amount of time it stays in the pit stop section recharging. Furthermore, charging a toy vehicle to its maximum battery capacity allows it to travel its maximum distance before needing another recharge.

Referring back to FIGS. 2A-B, the track set 202 includes a dual loop section 208 coupled to the pit stop section 210. The dual loop section 208 comprises a first loop 207 and a second loop 209 connected to the right lane 224 and second lane 226, respectively. The dual loop section 208 is configured such that a toy vehicle 204 traveling in the right lane 224 of the pit stop section 210 may be guided to travel through the first loop 207 and a toy vehicle 206 traveling in the left lane 226 of the pit stop section 210 may be guided to travel through the second loop 209. In addition to the first and second loops 207, 209, the dual loop section 208 further includes diverters for each lane that control whether a toy vehicle travels through a respective loop or bypasses the loop. For instance, diverter 212 controls whether toy vehicle 206 travels through the loop 209 or bypasses the loop 209.

Figure 5:
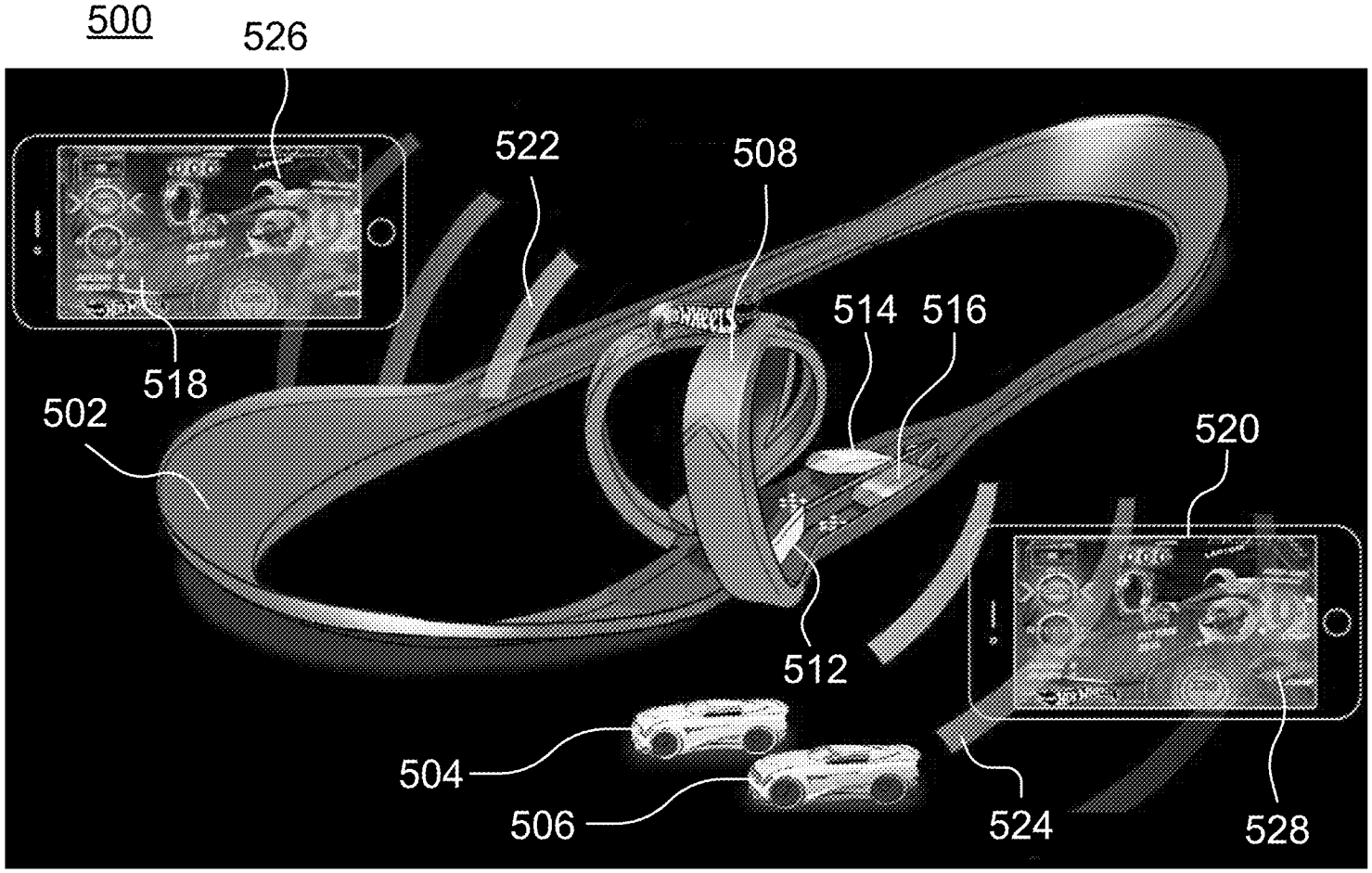
FIG. 5 illustrates a perspective view of a toy vehicle racing system, in accordance with another embodiment of the invention.

FIG. 5 shows an illustrative embodiment of a toy vehicle racing system 500. The toy vehicle racing system 500 includes two remote controls 518, 520 in wireless communication with the track set 502. Each remote control includes a transmitter and receiver. In one or more embodiments, the remote controls 518, 520 are controllers specifically designed to communicate with the track set 502. In other embodiments (as shown in FIG. 5), the remote controls 518, 520 are iOS™ or Android™-based smartphones (e.g., Apple iPhone™, Samsung Galaxy™, Google Pixel™) or tablets (e.g., Apple iPad™, Amazon Kindle™, Nabi™ Tablet, Samsung Galaxy™ Tablet) that run application software or apps that allow for wireless communication with the track set 502.

The remote controls 518, 520 are configured to transmit instructions to the track set 502 as well as receive information from the track set 502. Typically, the first remote control 518 communicates with the track set 502 through a first communication protocol 522. The second remote control 520 communicates with the track set 502 through a second communication protocol 524. In an exemplary implementation, the remote controls 518, 520 and the track set 502 communicate using Bluetooth™, though any other wireless technology standard such as IrDA, Wi-Fi™, and Li-Fi may also be used.

In one or more embodiments, the second communication protocol 524 is different from the first communication protocol 522. In one such embodiment, the first remote control 518 is configured to transmit instructions to and receive information from the track set 502. The second remote control 520 is configured to transmit instructions to and receive information from the first remote control 518. The first remote control 518 relays the instructions transmitted by the second remote control 520 to the track set 502 and further relays the information received from the track set 502 to the second remote control 520. Such a communication scheme may be implemented in instances where the limitations of the wireless technology used only allow the track set 502 to wirelessly communicate with one paired device (i.e., a single remote control) at a time. In one example, the first remote control 518 wirelessly communicates with the track set 502 using Bluetooth™, and both remote controls 518, 520 communicate by being connected to the same WiFi network. In one or more other embodiments, the track set 502 is able to directly communicate with both remote controls 518, 520 simultaneously.

Each remote control 518, 520 is configured to transmit instructions to the track set 502 (either directly or indirectly) to control one or more features or mechanisms on the track set 502. Each remote control 518, 520 may be configured to control separate features and mechanisms on the track set 502, or control some or all of the same features and mechanisms. For example, remote control 518 is able to control the closing and opening of pit stop gate 514, which results in the retaining or releasing of the toy vehicle 504 as it passes through the pit stop section of the track set 502. Similarly, remote control 520 controls the closing and opening of pit stop gate 516, which retains or releases the toy vehicle 506 as it passes through the pit stop section of the track set 502. In some instances, the remote controls 518, 520 are further able to control or interfere with the closing and opening of the other pit stop gate (e.g., remote control 518 controlling or interfering with the movement of pit stop gate 516).

While a toy vehicle is retained by a pit stop gate, the remote control can further control and adjust the power delivered to the toy vehicle. Each remote control 518, 520 is configured to provide instructions to the charging controller on the track set 502 that regulates the power delivered to the toy vehicle through the electrical contacts contacting the bottom of the toy vehicle while it is retained by the pit stop gate. This includes controlling the charging speed and/or the percentage of battery capacity to be charged. For example, remote control 518 is able to instruct the charging controller to provide greater power and charge the toy vehicle 504 more rapidly or to only charge the toy vehicle 504 to 75% of its full battery capacity.

The remote control can further instruct the diverter to direct the toy vehicle to travel along a loop in the dual loop section 508 or bypass the loop. For example, remote control 520 is able to control the movement of the diverter 512. As shown in FIG. 5, the diverter 512 is currently positioned such that toy vehicle 506 makes a loop at the dual loop section 508. The remote control 520 can instruct the diverter 512 to pivot to the right such that the toy vehicle 506 bypasses the dual loop section 508 and travels directly to the next portion of the track set 502.

Each remote control 518, 520 is also configured to receive information from the track set 502 regarding the track set 502 and/or toy vehicles 504, 506. Each remote control 518, 520 may be configured to receive separate information about the track set 502, or receive some or all of the same information. In one or more embodiments, the remote control 518, 520 receives information about the activation status of a mechanism or feature of the track set 502. In one example, the remote control 518 receives information on whether the pit stop gate 514 is currently open or closed. In another example, the remote control 520 receives information on whether the diverter 512 is currently positioned to direct the toy vehicle 506 towards a loop or positioned to allow a toy vehicle to bypass the loop.

In other embodiments, the remote controls 518, 520 receive information or feedback when a track set sensor on the track set 502 is triggered. The track sensor may be triggered by the detection of movement/positioning of a mechanism of the track set 502 or by a toy vehicle 504, 506 traveling on the track set 502. Various sensors and methods for detecting movement and/or positioning may be used, which include any mechanical, electrical, and optical techniques.

In one example, a track set sensor detects when a toy vehicle is trapped/retained in a closed pit stop gate or released from an open pit stop gate. In another example, the track set sensor detects when a toy vehicle is diverted by a diverter. In yet another example, the track set sensor detects when a toy vehicle passes the track set sensor while traveling on the track set. In one instance, an infrared or laser tripwire is used as a lap counter. In another instance, two laser tripwires are used to measure the speed of a toy vehicle. Multiple sensors may also be placed along the track set 502 to monitor the position of a toy vehicle racing on the track set 502.

In other embodiments, the remote controls 518, 520 receive information from the track set 502 about the stored battery charge of a toy vehicle. In an exemplary implementation, the track set detects the state of charge of a toy vehicle's battery while the toy vehicle is retained by a pit stop gate and contacting the electrical contacts of the track set 502. The track set then transmits this information to one or both remote controls.

In yet other embodiments, the remote controls 518, 520 directly send instructions to and/or receive information from one or more toy vehicles. For example, the remote control 518 may send instructions steering or controlling the movement of the toy vehicle 504. The remote control 518 may also receive various information from the toy vehicle 504, such as its speed, distance traveled, state of battery charge, etc.

In preferred embodiments, the remote controls 518, 520 include display screens 526, 528, respectively. The display screens 526, 528 are configured to display data and information received from the track set 502. Examples of the information that may be displayed on a display screen include the activation status of a mechanism or feature of the track set, the triggering of a track set sensor, the state of charge of a toy vehicle's battery, the number of laps completed by a toy vehicle around the track set, the speed of a toy vehicle, and the position of the toy vehicle on the track set.

In some embodiments, the display screens 526, 528 are further configured to display possible commands or instructions that may be transmitted to the track set 502 to control one or more features or mechanisms of the track set 502. Examples include controlling and adjusting the power delivered to a toy vehicle, closing and opening of a pit stop gate, and controlling the movement of a diverter.

In the illustrative embodiment shown in FIG. 5, the information received from the track set 502 and the possible commands or instructions that may be transmitted to the track set 502 are simultaneously displayed on the display screens 526, 528. The display screens 526, 528 are touch-screens that allow a user to activate the command or instruction by contacting an icon or image displayed on the display screen 526, 528 representing the command/instruction. In other embodiments, the remote controls 518, 520 include physical/mechanical controls such as buttons, joysticks, levers, and dials that a user can operate to perform various commands.

The remote controls 518, 520 further generate audio, optical, and/or haptic feedback when the status or information regarding the track set or toy vehicle has changed or when a command or instruction has been transmitted or executed. For example, the remote control may vibrate or include an LED that illuminates when a command had been transmitted, a moveable mechanism had been activated, or a wireless connection had been established with the track set.

In another aspect of the invention, the remote controls 518, 520 are used to provide augmented reality (AR) to the toy vehicle racing system 500. Augmented reality allows users to experience digital gameplay while racing toy vehicles in a real-world environment. This is accomplished by overlaying or "augmenting" elements of the real-world environment displayed on the remote controls with computer-generated perceptual information. The overlaid perceptual information can be constructive (i.e., additive to the real-world environment) or destructive (i.e., masking of the real-world environment) and is seamlessly incorporated so as to be perceived as an immersive, interactive, and/or digitally manipulable aspect of the real-world environment.

In one or more embodiments, the remote control has a camera configured to capture a real-time video feed of the track set and the toy vehicles racing on the track set (i.e., video see-through). The remote control also has a processor configured to generate a composite view comprising one or more computer-generated images superimposed on the real-time video feed. This composite view is displayed on the display screen of the remote control. Mobile computing devices such as smartphones, tablet computers, and other smart devices typically have a built-in digital camera, processor, memory, and sensors (e.g., accelerometer) and are particularly suitable as AR-capable remote controls for the toy vehicle racing system.

Using computer vision and video tracking methods, the processor determines the relative position of the track set in the video feed. In addition to the camera, the remote control may use one or more additional sensors and/or markers, such as micro-electro-mechanical system (MEMS) sensors, accelerometers, gyroscopes, radio-frequency identification (RFID) tags, and optical markers, to provide additional accuracy and precision. The processor analyzes the sensed visual and other data to synthesize and position one or more computer-generated images on the video feed in real-time. The processor constantly updates the computer-generated images based on information/feedback received from the track set and the position/orientation of the track set as captured in the video feed.

In an exemplary implementation with the toy vehicle racing system 500 shown in FIG. 5, a user holds the remote control 518 such that the camera on the side opposite the display screen 526 is directed towards the track set 502. From the video feed captured by the camera, the remote control 518 identifies the first toy vehicle 504, second toy vehicle 506, and/or track set 502. The remote control 518 determines the orientation of the track set 502 and superimposes computer-generated images onto the video feed, for example on a portion of the first toy vehicle, second toy vehicle, and/or track set. This composite AR video feed is displayed on the screen 526 in real-time. The user can move around the track with the remote control and the positioning/orientation of the superimposed images displayed on the display screen 526 would remain accurate. Furthermore, multiple users can each hold a remote control and view the same AR at the same time from different angles.

FIGS. 6A-D show various illustrative image frames of an AR video feed displayed on a remote control. In the image frame shown in FIG. 6A, an attack sphere image 604 is superimposed and positioned within the dual loop section 606 of the track set 602. Even though the position of the track set 602 is shifted in the image frame shown in FIG. 6B, the attack sphere image 604 remains within the dual loop section 606. Additionally, a superimposed center billboard image 608 is positioned in the center of the track set 602. The center billboard image 608 adapts to the user's viewing angle/position, thereby giving the center billboard image 608 a three-dimensional effect. Other elements to help make the racing more immersive and exciting may include a cheering crowd, fireworks when the race ends, a control tower, and lighting/decorative effects on the track set.

In addition to superimposed images that adapt to the user's viewing angle (e.g., attack sphere image 604, center billboard image 608), the AR video feed also includes superimposed images that are positioned at specific areas of the display regardless of the user's viewing angle/position. These images may display information received from the track set or provide an interactive element for activating a command or instruction. For example, in FIGS. 6A-B, positioned on the upper right corner is a battery gauge 610 that indicates the state-of-charge of the toy vehicle. Also along the top of the screen is a lap counter 612 indicating the number of laps completed, a ranking indicator 614, and racing progress indicator 616. On the bottom of the screen is a missile attack counter 618, an on-screen button 628 for launching a missile attack, and an on-screen button 620 for repairing the toy vehicle.

Now referring to FIGS. 5 and 6A-D, an illustrative example of a possible gameplay with the toy vehicle racing system 500 is described. Two users each use a smartphone running an app specifically designed for the toy vehicle racing system 500 as remote controls 518, 520. The remote controls 518, 520 include on-screen tutorials that teach the users how to physically build the track set 502 as well as how to play or race the vehicles 504, 506. The on-screen tutorial also provides instructions on how to establish a wireless connection between the remote controls 518, 520 and the track set 502. In one instance, one of the vehicles 504, 506 may be controlled by artificial intelligence (AI). This allows a single user to race a toy vehicle against a virtual computer opponent. Here, the two users race against each other using separate vehicles.

The users then place their toy vehicles 504, 506 behind pit stop gates 514, 516, respectively. Both users scan the track set 502 with their respective remote controls 518, 520 so that the remote controls 518, 520 can analyze the orientation/position of the track set 502 and apply AR elements. When the remote controls 518, 520 have finished applying the AR elements, the toy vehicles 504, 506 are released by the pit stop gates 514, 516 at the same time to commence racing.

With the remote controls 518, 520, each user is able to remotely control a respective pit stop gate 514, 516 for their toy vehicle 504, 506 and a diverter that directs the toy vehicle to bypass or travel along a loop. Tapping the on-screen missile button 628 instructs the diverter to be positioned so that the toy vehicle travels along a loop. When a toy vehicle successfully performs a loop in the loop section, an attack is collected and the diverter reverts back to a position that allows the toy vehicle to bypass the loop section. Tapping the battery gauge button 610 instructs the pit stop gate to close and trap the toy vehicle. While trapped by the pit stop gate, the toy vehicle is charged with the current battery charge being displayed on the remote control. Tapping the battery gauge button 610 again instructs the pit stop gate to open and release the toy vehicle. Since the vehicle is constantly draining battery charge as it is racing, timing the pit stop recharges adds a further element of strategy to the racing.

While the remote control is pointed towards the track set 502, each user sees a composite video feed of the track set 502, toy vehicles 504, 506, and AR elements. One AR element is an attack sphere 604 within the dual loop section 606 representing an available missile attack. When the attack sphere 604 is collected by a vehicle successfully performing a loop in the dual loop section 606, a certain amount of time must elapse before the attack sphere 604 will reappear within the loop section 606 (when viewed on the display screen of the remote control). Performing a loop when the attack sphere 604 is not present does not give the user an attack. Since successfully performing a loop requires the toy vehicle to travel at a certain minimal speed, maintaining sufficient speed and charge of the toy vehicle while racing is important.

During the race, virtual attacks may be performed to slow down the opponent's toy vehicle. When an attack is available, as indicated from the missile attack counter 618, the user can tap the on-screen missile icon 628 to launch an attack against the opponent. When a user is attacked, the user plays a mini-game on the remote control to avoid the attack. If the attack is successfully avoided, the toy vehicle continues racing on the track set. If the user fails to avoid the attack, a graphic representing the damaged toy vehicle is shown on the screen. The respective pit stop gate closes automatically and the toy vehicle is then trapped by the pit stop gate until it is "fixed". The user then plays a separate mini-game on the remote control to "fix" the damaged toy vehicle graphic. Successfully completing the mini-game opens the pit stop gate and allows the toy vehicle to continue racing. The racing ends when a toy vehicle is too damaged or when a toy vehicle first reaches a set number of laps around the track set 502. If the toy vehicles crash and fall off the track set 502 while racing, the users can simply put them back onto the track set 502 to resume racing.

Figure 6A:
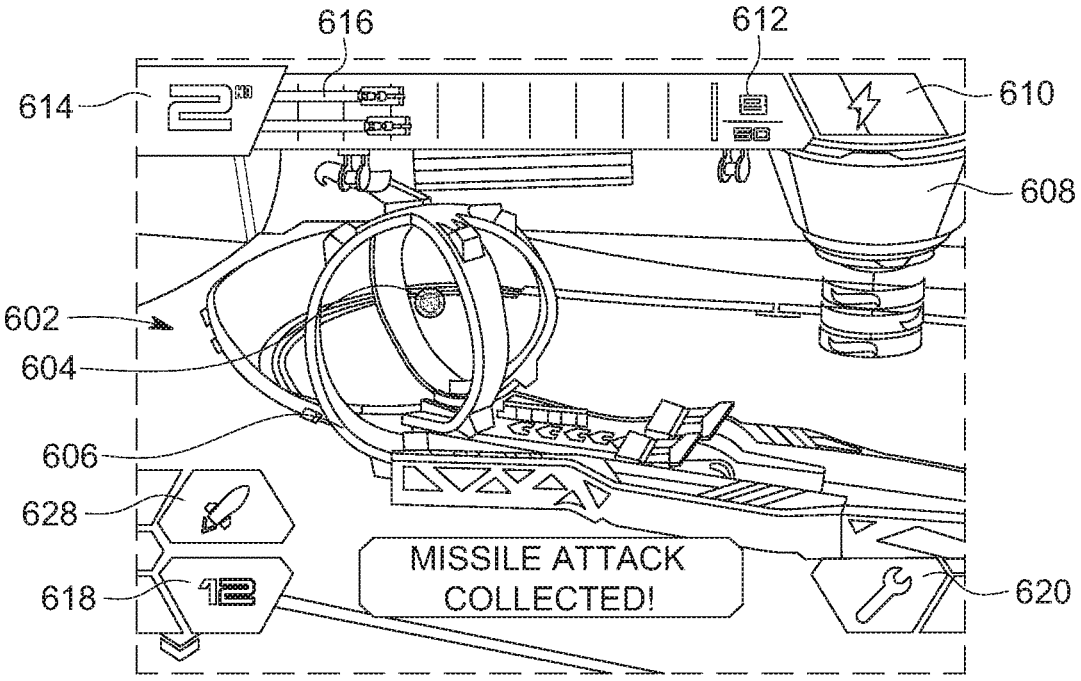
FIGS. 6A-D illustrate various image frames of an augmented reality video feed displayed on a remote control, in accordance with an embodiment of the invention.
Figure 6B:
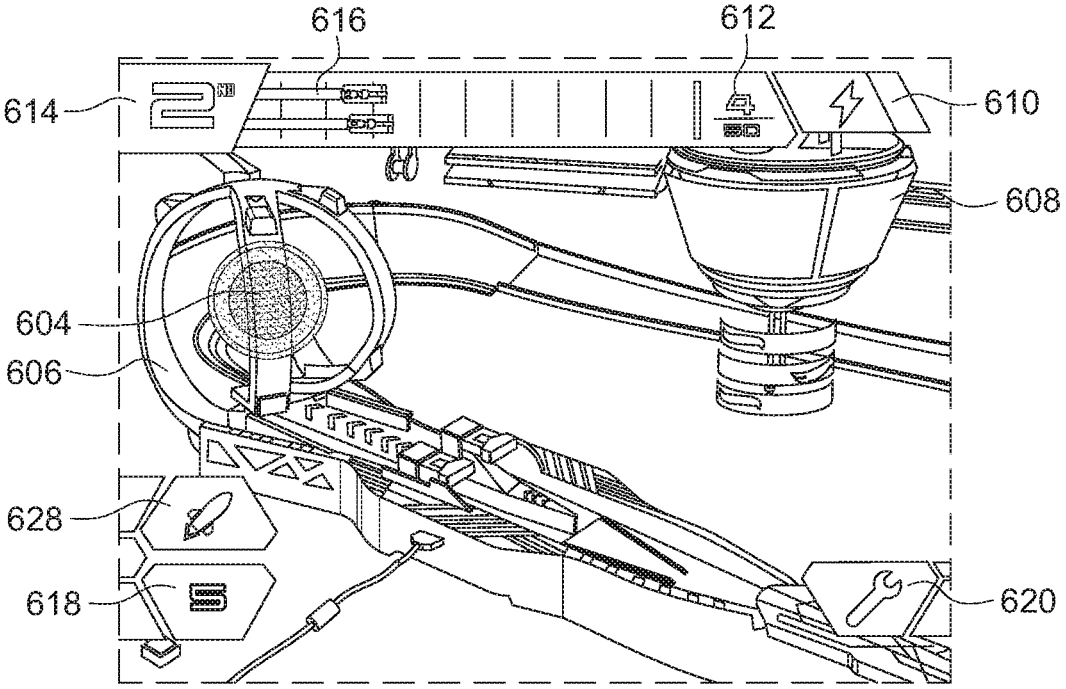
Figure 6C:
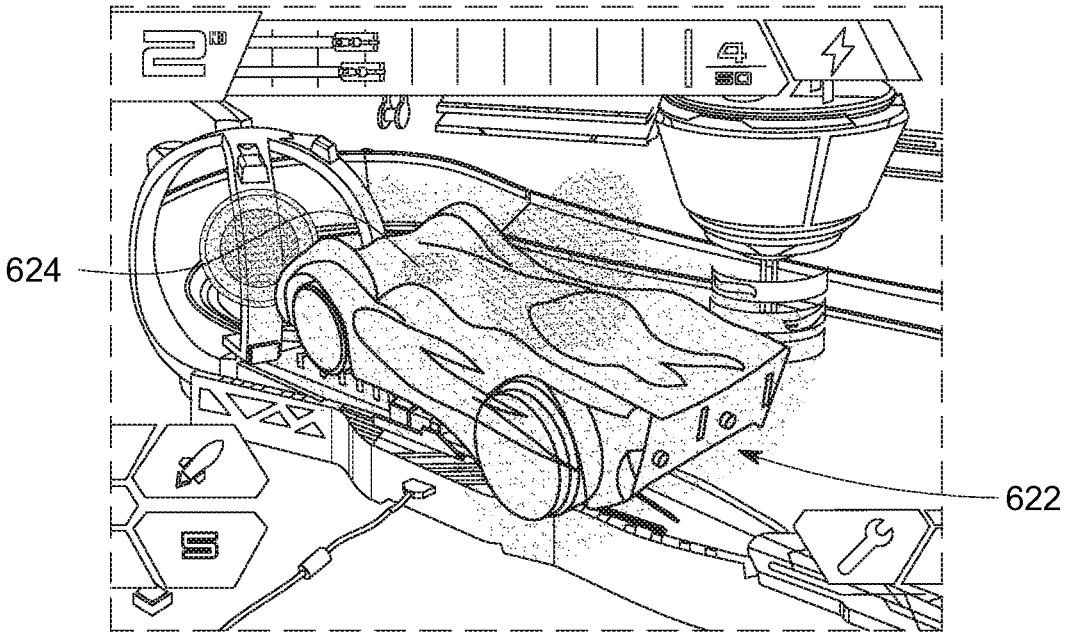
Figure 6D:
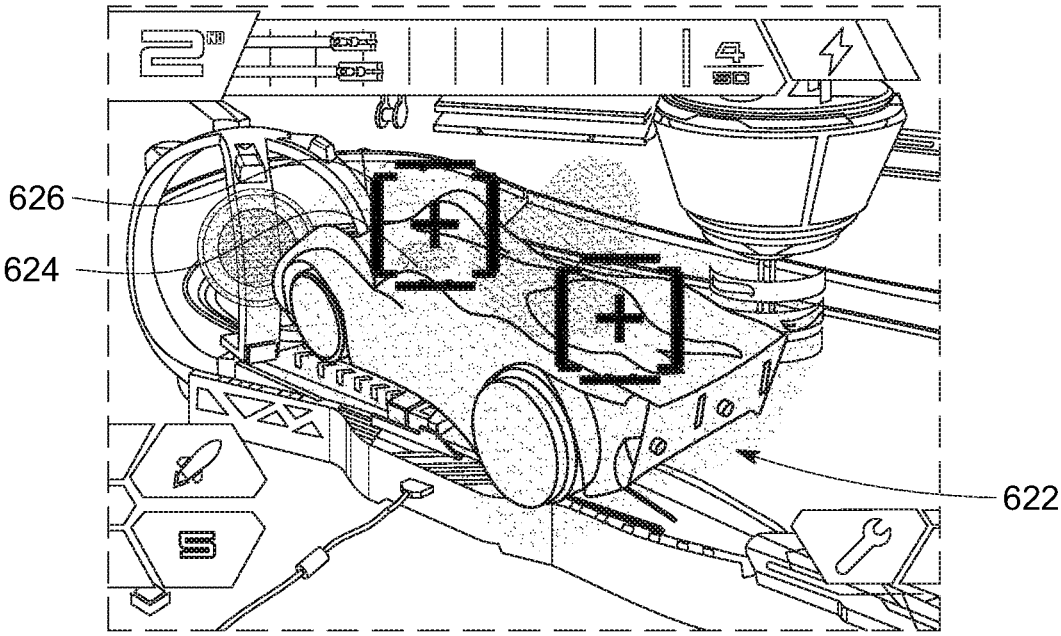

FIGS. 6C-D show various image frames of an AR video feed displayed on a remote control when a toy vehicle is attacked. In FIG. 6C, a visual representation of the toy vehicle 622 is shown with smoke and damage 624. In FIG. 6D, repair targets 626 appear over the smoke and damage 624. The user then needs to tap the repair targets 626 on-screen to "repair" the damaged toy vehicle. In other embodiments, the remote control can be physically moved around to control/move virtual tools to repair the toy vehicle in AR. For example, the remote control may be moved around to position and replace damaged virtual tires on a toy vehicle with new tires.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims.

Moreover, it is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, the term "exemplary" may be used herein to describe an example or illustration. Any embodiment described herein as exemplary is not to be construed as a preferred or advantageous embodiment, but rather as one example or illustration of a possible embodiment of the invention.

Finally, various features from one of the embodiments may be incorporated into another of the embodiments. Accordingly, it is appropriate that the appended claims be construed broadly and in a manner consistent with the scope of the disclosure as set forth in the following claims.

The invention claimed is:

1. A toy vehicle racing system comprising:

a track set including a movable mechanism and an electrical contact, the movable mechanism being repositionable between a first position and a second position, wherein, when the movable mechanism is in the first position, the electrical contact is recessed into a surface of the track set, and when the movable mechanism is in the second position, the electrical contact protrudes above the surface of the track set;

a toy vehicle configured to travel along the track set and interact with the movable mechanism, the toy vehicle comprising a battery, wherein, when the toy vehicle is interacting with the movable mechanism in the second position, the electrical contact of the track set contacts the toy vehicle to charge the battery of the toy vehicle; and a remote control in wireless communication with the track set, the remote control configured to transmit instructions to the track set to move the movable mechanism and further configured to receive information from the track set regarding the track set and/or toy vehicle.

2. The racing system of claim 1, wherein the information received from the track set includes at least one of an activation status of the movable mechanism, stored battery charge of the toy vehicle, and triggering of a sensor on the track set.

3. The racing system of claim 1, wherein the instructions transmitted to the track set include at least one of moving the movable mechanism and delivering power to the toy vehicle at a selected charging speed and/or to a selected percentage of a battery capacity.

4. The racing system of claim 1, wherein the movable mechanism is a pit stop gate that traps the toy vehicle while the pit stop gate is activated.

5. The racing system of claim 1, wherein the movable mechanism is a pit stop gate and the track set further comprises:

a charging controller for selectively delivering power to the toy vehicle through the electrical contact while the toy vehicle is trapped by the pit stop gate, the charging controller regulating a charging speed and/or an amount of power delivered to the toy vehicle.

6. The racing system of claim 1, wherein the remote control receives information when a track set sensor on the track set is triggered, the track set sensor being triggered when the toy vehicle is diverted by a diverter, trapped by a pit stop gate, released by the pit stop gate, or passes the track set sensor while traveling on the track set.

7. A toy vehicle racing system comprising:

a track set including a first movable mechanism and a second movable mechanism;

a first toy vehicle and a second toy vehicle configured to travel along the track set and respectively interact with the first and second movable mechanisms;

a first remote control in wireless communication with the track set, the first remote control configured to transmit instructions to the track set to move the first and/or second movable mechanism and further configured to receive information from the track set regarding the track set, the first toy vehicle, and/or the second toy vehicle; and a second remote control in wireless communication with the first remote control, the second remote control configured to transmit instructions to the first remote control to move the first and/or second movable mechanism and further configured to receive information from the first remote control regarding the track set, the first toy vehicle, and/or the second toy vehicle;

wherein the first remote control relays the instructions transmitted by the second remote control to the track set and further relays the information received from the track set to the second remote control.

8. The racing system of claim 7, wherein the information received from the track set by the first or second remote control includes at least one of an activation status of the first or second movable mechanism, stored battery charge of the first or second toy vehicle, and triggering of a first or second sensor on the track set.

9. The racing system of claim 7, wherein the instructions transmitted to the track set by the first or second remote control include at least one of moving the first or second movable mechanism and delivering power to the first or second toy vehicle at a selected charging speed and/or to a selected percentage of a battery capacity.

10. The racing system of claim 7, wherein the first and second movable mechanisms are diverters that respectively divert the first or second toy vehicles traveling on the track set while the diverter is activated or pit stop gates that respectively trap the first or second toy vehicle while the pit stop gate is activated.

11. The racing system of claim 7, wherein the movable mechanism is a pit stop gate and the track set further comprises:

electrical contacts that respectively contact the first or second toy vehicle while the respective toy vehicle is trapped by the pit stop gate; and a charging controller for selectively delivering power to the first or second toy vehicle through the electrical contacts while the respective toy vehicle is trapped by the pit stop gate, the charging controller regulating a charging speed and/or an amount of power delivered to the first or second toy vehicle.

12. The racing system of claim 7, wherein the first remote control communicates with the track set using a first communication protocol and the second remote control communicates with the track set using a second communication protocol, the second communication protocol different from the first communication protocol.

13. A toy vehicle racing system comprising:

a track set including a first movable mechanism and a second movable mechanism;

a first toy vehicle and a second toy vehicle configured to travel along the track set and respectively interact with the first and second movable mechanisms;

a first remote control in wireless communication with the track set, the first remote control including a first camera configured to capture a first real-time video feed, a first processor configured to generate a first composite view comprising a first computer- generated image superimposed on the first real-time video feed, and a first display screen configured to display the first composite view; and a second remote control in wireless communication with the first remote control, the second remote control including a second camera configured to capture a second real-time video feed, a second processor configured to generate a second composite view comprising a second computer-generated image superimposed on the second real-time video feed, and a second display screen configured to display the second composite view;

wherein:

the first remote control is configured to transmit instructions to the track set to move the first and/or second movable mechanism, to receive information from the track set regarding the track set, the first toy vehicle, and/or the second toy vehicle, and to update the first computer-generated image based on the received information;

the second remote control is configured to transmit instructions to the first remote control to move the first and/or second movable mechanism, to receive information from the first remote control regarding the track set, the first toy vehicle, and/or the second toy vehicle, and to update the second computer-generated image based on the received information; and the first remote control relays the instructions transmitted by the second remote control to the track set and further relays the information received from the track set to the second remote control.

14. The racing system of claim 13, wherein the information received from the track set by the first or second remote control includes at least one of an activation status of the first or second movable mechanism, stored battery charge of the first or second toy vehicle, and triggering of a first or second sensor on the track set.

15. The racing system of claim 13, wherein the instructions transmitted to the track set by the first or second remote control include at least one of moving the first or second movable mechanism and delivering power to the first or second toy vehicle at a selected charging speed and/or to a selected percentage of a battery capacity.

16. The racing system of claim 13, wherein the first and second movable mechanisms are diverters that respectively divert the first or second toy vehicles traveling on the track set while the diverter is activated or pit stop gates that respectively trap the first or second toy vehicle while the pit stop gate is activated.

17. The racing system of claim 13, wherein the movable mechanism is a pit stop gate and the track set further comprises:

electrical contacts that respectively contact the first or second toy vehicle while the respective toy vehicle is trapped by the pit stop gate; and a charging controller for selectively delivering power to the first or second toy vehicle through the electrical contacts while the respective toy vehicle is trapped by the pit stop gate, the charging controller regulating a charging speed and/or an amount of power delivered to the first or second toy vehicle.

18. The racing system of claim 13, wherein the first and second remote controls receive information when a first track set sensor or a second track set sensor on the track set is triggered, the first or second track set sensor being triggered when the first or second toy vehicle is diverted by a diverter, trapped by a pit stop gate, released by the pit stop gate, or passes the first or second track set sensor while traveling on the track set.

19. The racing system of claim 13, wherein:

the first processor is configured to recognize the first toy vehicle, second toy vehicle, and/or track set in the first real-time video feed from the first camera and superimpose the first computer-generated image on a portion of the first toy vehicle, second toy vehicle, and/or track set in the first real-time video feed; and the second processor is configured to recognize the first toy vehicle, second toy vehicle, and/or track set in the second real-time video feed from the second camera and superimpose the second computer-generated image on a portion of the first toy vehicle, second toy vehicle, and/or track set in the second real-time video feed.

20. The racing system of claim 13, wherein:

the first and second display screens are touchscreens and the first and second computer-generated images respectively represent first and second interactive elements; and contacting the first or second interactive elements on the respective first or second display screens causes the respective first or second remote control to transmit instructions to the track set.

* * * * *